US008346136B2

(12) United States Patent
Maeda et al.

(10) Patent No.: US 8,346,136 B2
(45) Date of Patent: Jan. 1, 2013

(54) ELECTRODE CONFIGURATION FOR CARRYING DEVELOPER IN A DEVELOPER CARRYING DEVICE AND IMAGE FORMING DEVICE

(75) Inventors: Masataka Maeda, Aichi (JP); Kenjiro Nishiwaki, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 573 days.

(21) Appl. No.: 12/474,883

(22) Filed: May 29, 2009

(65) Prior Publication Data

US 2009/0297228 A1 Dec. 3, 2009

Related U.S. Application Data

(63) Continuation-in-part of application No. PCT/JP2007/072807, filed on Nov. 27, 2007.

(30) Foreign Application Priority Data

Nov. 30, 2006 (JP) ..... 2006-324542

(51) Int. Cl.
*G03G 15/08* (2006.01)

(52) U.S. Cl. ..... 399/266

(58) Field of Classification Search ..... 399/55, 399/240–244, 265, 266, 285, 107, 289–295
See application file for complete search history.

(56) References Cited

U.S. PATENT DOCUMENTS

| | | | |
|---|---|---|---|
| 5,027,157 | A | 6/1991 | Hotomi et al. |
| 5,142,336 | A | 8/1992 | Hotomi et al. |
| 5,697,026 | A | 12/1997 | Matsumae et al. |
| 6,941,098 | B2 | 9/2005 | Miyaguchi et al. |
| 2003/0210928 | A1 | 11/2003 | Miyaguchi et al. |
| 2004/0037593 | A1 | 2/2004 | Sakuma et al. |
| 2005/0152717 | A1 * | 7/2005 | Miyaguchi et al. |
| 2006/0088337 | A1 | 4/2006 | Nakazato et al. |
| 2006/0133858 | A1 * | 6/2006 | Hirayama et al. |
| 2006/0210320 | A1 * | 9/2006 | Nakagawa et al. ..... 399/265 |

FOREIGN PATENT DOCUMENTS

| | | | |
|---|---|---|---|
| JP | 63-013075 | | 1/1988 |
| JP | 63-130750 | A | 6/1988 |
| JP | 02-160266 | | 6/1990 |
| JP | 2002278258 | A * | 9/2002 |
| JP | 2002-287495 | | 10/2002 |
| JP | 2002-307740 | | 10/2002 |
| JP | 2003-265982 | | 9/2003 |
| JP | 2006-259411 | | 9/2006 |
| WO | 2008/066015 | | 6/2008 |

OTHER PUBLICATIONS

Japanese Office Action received for counterpart JP Application No. 2008-546986, mailed Jan. 19, 2010.
International Search Report dated Jan. 15, 2008 from International application No. PCT/JP2007/072807.
Extended European Search Report dated May 11, 2011 in Application No. 07832532.1.

* cited by examiner

*Primary Examiner* — Walter L Lindsay, Jr.
*Assistant Examiner* — Milton Gonzalez
(74) *Attorney, Agent, or Firm* — Banner & Witcoff, Ltd.

(57) ABSTRACT

There is provided a developer carrying device, including a first carrying body having a first electrode group configured to form a traveling electric field while being applied a voltage sequentially and to circulate charged developer through a facing portion with respect to a developer supply target; and a second carrying body having a second electrode group configured to form a traveling electric field while being applied a voltage sequentially and to circulate the developer through a facing part with respect to the first electrode group so that the developer being carried is supplied to the first carrying body.

17 Claims, 7 Drawing Sheets

ELECTRODE CONFIGURATION FOR CARRYING DEVELOPER IN A DEVELOPER CARRYING DEVICE AND IMAGE FORMING DEVICE

This is a Continuation-in-Part of International Application No. PCT/JP2007/072807 filed Nov. 27, 2007, which claims priority from Japanese Patent Application No. 2006-324542 filed Nov. 30, 2006. The entire disclosure of the prior application is hereby incorporated by reference herein its entirety.

BACKGROUND

1. Technical Field

Aspects of the present invention relate to a developer carrying device which carries charged developer through a traveling electric filed, and an image forming device having such a developer carrying device.

2. Related Art

Conventionally, various types of developer carrying devices configured to carry charged developer through use of a plurality of electrodes which form a traveling electric field when applied voltages in sequence have been proposed. For example, Japanese Patent Provisional Publication No. 2003-265982 discloses a developer carrying device which includes an opposed carrying substrate having a first electrode group carrying developer to a facing portion facing a photosensitive drum through a traveling electric field, and a carrying substrate having a second electrode group carrying the developer from a reservoir of the developer to a facing portion facing the opposed substrate through a traveling electric field. In this specification, the term "charged" means a positively charged state unless otherwise noted.

In the developer carrying device, a bias voltage is applied at a portion where the first electrode group and the second electrode group face with each other so that the developer in a desirably charged state is moved from the carrying substrate to the opposed carrying substrate.

DISCLOSURE OF THE INVENTION

However, in the device disclosed in the publication, the opposed carrying substrate is formed to have both ends as illustrated, for example, in FIG. 47 of the publication. Therefore, in the device, new developer is carried successively to the facing portion facing the photosensitive drum, and the developer not supplied to the photosensitive drum is returned to the reservoir. For this reason, there is a possibility that the condition of the developer fluctuates and thereby development can not be performed suitably arises in the cases explained below.

For example, there is a case where a cluster of developer caused by moisture is carried. Since the developer in the inside of such a cluster of developer can not be charged by friction while being carried, the charged amount may be small and such developer may be charged negatively. Therefore, if the cluster of toner collapses while being carried, the developer which has been included in the inside of the cluster is carried to the photosensitive drum in a state where the developer can not be sufficiently charged by friction. In addition, if the cluster of developer is carried to the photosensitive drum and collapse in the vicinity of the photosensitive drum, the developer whose charged amount is very small or the negatively charged developer are scattered around the photosensitive drum. In these cases, a possibility that suitable development can not be achieved due to shortage of the sufficiently charged developer required for development arises. Therefore, it is desired to suppress the state of the developer, namely variations of the charged state of the developer, so that the sufficiently charged toner is supplied to a developer supply target such as a photosensitive drum.

For the above describe reasons, the object of the present invention is to provide a developer carrying device and an image forming device configured to suppress variations of the charged state of developer and to carry the sufficiently charged developer to a developer supply target.

According to an aspect of the invention, there is provided a developer carrying device, comprising: a first carrying body having a first electrode group configured to form a traveling electric field while being applied a voltage sequentially and to circulate charged developer through a facing portion with respect to a developer supply target; a second carrying body having a second electrode group configured to form a traveling electric field while being applied a voltage sequentially and to circulate the developer through a facing part with respect to the first electrode group so that the developer being carried is supplied to the first carrying body.

In the developer carrying device according to the invention configured as above, the developer circulates on the first carrying body through the facing portion with respect to the developer carry target by the traveling electric field formed by the first electrode group, and circulates on the second carrying body through the facing portion with respect to the first electrode group by the traveling electric field formed by the second electrode group. Then, when part of the developer circulating on the first carrying body is supplied to the developer supply target, part of the developer circulating on the second carrying body is added to the first carrying body (i.e., the amount of developer corresponding to the supplied amount to the developer supply target) is added to the first carrying body so as to be circulated by the first electrode group.

As describe above, the developer circulates on the first carrying body, and only the small amount of developer corresponding to the supplied amount to the developer supply target is newly added to the first carrying body from the second carrying body. Therefore, almost all of the developer on the first carrying body is sufficiently charged positively by the frictional charge during circulation, and therefore variations of the charged state of the developer are small. Therefore, the sufficiently charged developer can be supplied to the developer supply target. Even if a cluster of developer is supplied from the second carrying body to the first carrying body, the added amount is limited, and such a cluster collapses while the cluster circulates on the first carrying body. That is, a cluster of developer can be prevented from reaching the developer supply target, and therefore the sufficiently charged developer can be supplied to the developer supply target.

Although the present invention is not limited to the configuration indicated below, the first electrode group may be continuously arranged to have a cylindrical shape. In this case, it becomes possible to circulate the developer on the first carrying body more smoothly.

A surface of the first electrode group may be made of material which charges the developer in a desired state. In this case, the developer circulating the first carrying body can be charged more suitably, and therefore it becomes possible to perform the development more smoothly.

The developer carrying device may further comprises a developer buffer which is configured to temporarily store the developer being circulated and is formed at least on a part of the first carrying body. In this case, the developer circulating on the first carrying body is temporarily stored in the developer buffer, and therefore, even if the developer at a certain portion is enormously supplied to the developer supply target, the effect thereof can be prevented from remaining.

In this case, the developer carrying device may further comprises a third carrying body having a third electrode group configured to form a traveling electric field while being applied a voltage sequentially and to carry the developer stored in the developer buffer to the second carrying body. In this case, it is possible to return the developer stored in the developer buffer to the second carrying body, and to supply new developer to the first carrying body. Therefore, it becomes possible to prevent alteration of the property of the developer due to storing in the developer buffer for a long time. The third carrying body may be formed as a part of the first carrying body, or may be provided separately.

In the developer carrying device, the voltage applied to the first electrode group and the voltage applied to the second electrode group may be defined such that the developer charged in a desired state is moved from the second carrying body to the first carrying body at least at the facing part where the first and second electrode groups face with each other, and carrying directions of the developer by the first and second electrode groups at the facing part may be opposite to each other.

In this case, since the voltages are applied in the above described manner to the first and second electrode groups at the facing part of the first and second electrode groups, it becomes possible to supply the desirably charged developer to the first carrying body preferentially, and therefore it becomes possible to suitably supply the desirably charged developer to the developer supply target. Since the carrying directions of the first and second carrying bodies at the facing part of the first and second electrodes are different from each other, the developer sufficiently charged in the desired polarity can be rapidly moved from the second carrying body to the first carrying body without staying at the facing part for a long tome, and is carried in the reverse direction. Furthermore, the developer not supplied to the developer supply target can also rapidly move from the first carrying body to the second carrying body, and therefore, even if the developer at the certain part is not enormously supplied to the developer supply target and remains in the developer carrying device, the effect thereof can be prevented from remaining.

The voltage applied to the first electrode group and the voltage applied to the second electrode group may be defined such that the developer charged in a desired state is moved from the second carrying body to the first carrying body at least at the facing part where the first and second electrode groups face with each other, and carrying directions of the developer by the first and second electrode groups at the facing part may be equal to each other.

In this case, since the voltages are applied in the above described manner to the first and second electrode groups at the facing part of the first and second electrode groups, it becomes possible to supply the desirably charged developer to the first carrying body preferentially, and therefore it becomes possible to suitably supply the desirably charged developer to the developer supply target. Since the carrying directions of the first and second carrying bodies at the facing part of the first and second electrodes are equal to each other, the time in which the developer stays at the facing part becomes long, and therefore it becomes possible to distribute the desirably charged developer more suitably and to move the developer to the first electrode body. Consequently, it becomes possible to supply the desirably charged developer to the developer supply target more accurately.

Various types of ways for voltage application at the facing part may be employed. For example, a potential difference may be caused between the voltage applied to the first electrode group and the voltage applied to the second electrode group. An amplitude of the voltage applied to the first electrode group and an amplitude of the voltage applied to the second electrode group may be different from each other, and an average voltage of the voltage applied to the first electrode group and an average voltage of the voltage applied to the second electrode group may be different from each other. A duty ratio of the voltage applied to the first electrode group and a duty ratio of the voltage applied to the second electrode group may be different from each other. In these cases, a potential difference is cased at least temporarily between the voltage applied to the first electrode group and the voltage applied to the second electrode group, and therefore the desirably charged developer is moved from the second electrode group to the first electrode group by the potential difference.

An amount of the developer circulated by the second electrode group may be larger than an amount of the developer circulated by the first electrode group. As describe above, in the present invention, the amount of developer corresponding to the developer supplied from the first carrying body to the developer supply target is added sequentially from the second carrying body to the first carrying body. If the amount of developer circulated by the second developer is larger than the developer circulated by the first electrode group, it becomes to suitably prevent occurrence of shortage of the developer to be supplied from the first electrode group to the developer supply target.

Various types of ways of defining the amount of developer circulated by the first electrode group and the second electrode group can be employed. For example, an absolute value of the voltage applied to the second electrode group may be larger than an absolute value of the voltage applied to the first electrode group. A frequency of the voltage applied to each electrode of the second electrode group may be higher than a frequency of the voltage applied to each electrode of the first electrode group. In these cases, by the difference between the carrying forces due to the difference of ways of voltage application, it becomes possible to set the amount of developer circulated by the second electrode group to a value larger than the amount of developer circulated by the first electrode group.

A width of the second carrying body may be larger than a width of the first carrying body. In this case, it is possible to move the stably charged developer (e.g., developer being carried in a central portion in the second carrying body) to the first carrying electrode preferentially, and therefore it becomes possible to more stably charged developer to the developer supply target.

An image forming device according to the present invention comprises: an electrostatic latent image holding body having a surface on which an electrostatic latent image is held; one of the above described developer carrying devices which use the electrostatic latent image holding body as the developer supply target; and a transfer unit which transfers the developer supplied to the electrostatic latent image holding body by the developer carrying device, to a recording medium.

In an image forming device according to the present invention, an electrostatic latent image is formed on a surface of an electrostatic latent image holding body; and one of the above described developer carrying devices carries the developer while using the electrostatic latent image holding body as the developer supply target. Therefore, the sufficiently charged developer in the low degree of variations of the charged state is supplied to the developer supply target, and therefore the electrostatic latent image can be developed stably. The developer used to develop the electrostatic latent image is transferred by the transferring unit to a recording medium. Therefore, in the image forming device according to the invention, it is possible to prevent deterioration of the image quality of an image formed on the recording medium, and to form a stable image.

BRIEF DESCRIPTION OF THE ACCOMPANYING DRAWINGS

FIG. 1 is an explanatory illustration representing generally a main mart of a laser printer to which the present invention is applied.

FIGS. 2 (A), (B) and (C) are a schematic view, a lateral cross section and a partial enlarged view of the lateral cross section representing the configuration of a development unit of the laser printer.

DETAILED DESCRIPTION

General Configuration of Laser Printer

Figure 1:
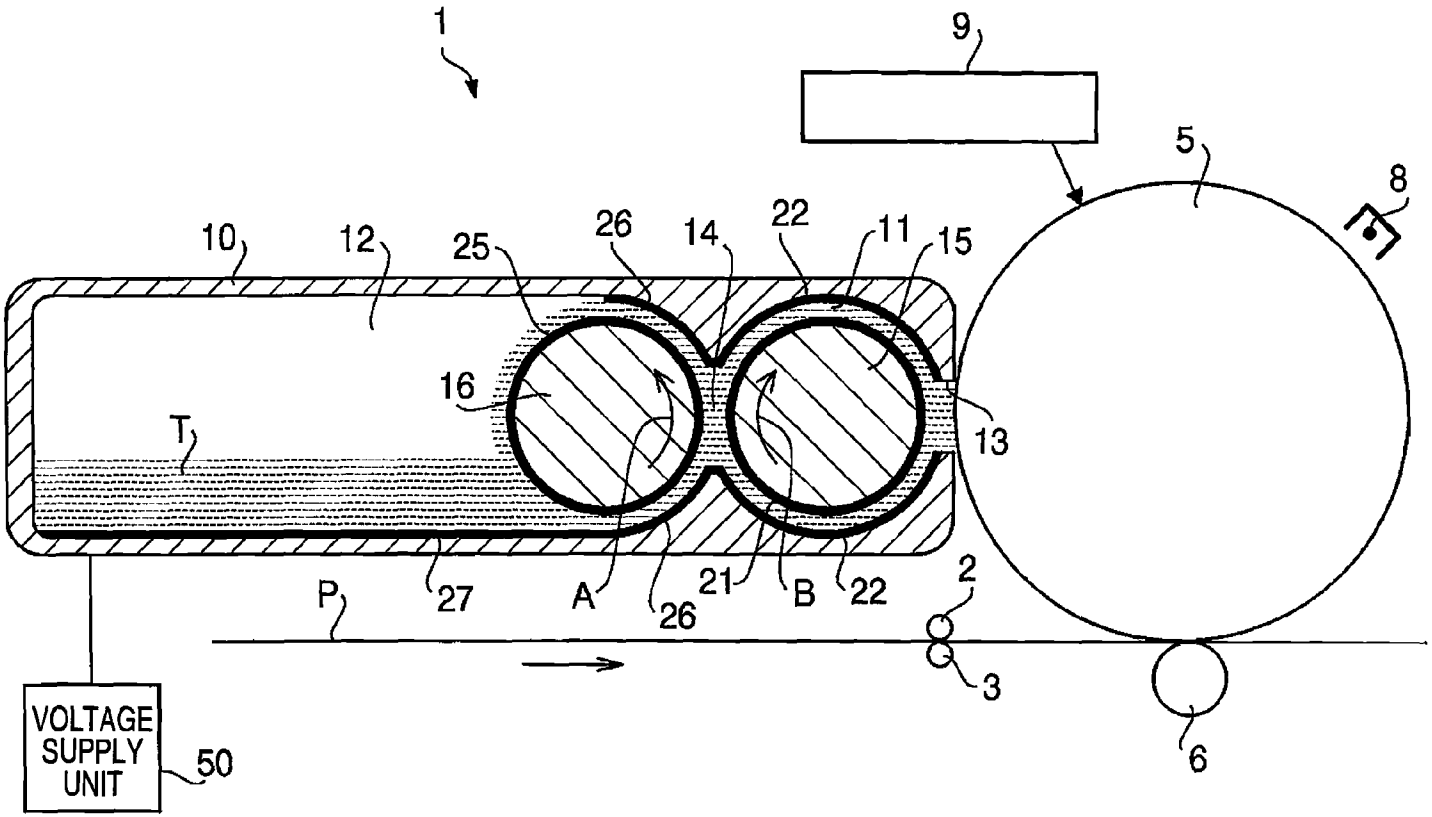

Hereafter, an embodiment according to the present invention will be described with reference to the accompanying drawings. FIG. 1 is an explanatory illustration for explaining main parts of a laser printer 1 according to the embodiment. It should be noted that the laser printer 1 configured to form an image by toner T on a surface of a sheet of paper P while carrying sheets of paper accommodated in a paper supply tray (not shown) one by one.

As shown in FIG. 1, the laser printer 1 includes registration rollers 2 and 3 controlled to properly hold the leading edge of the sheet of paper P supplied from a paper supply tray. The registration rollers 2 and 3 start to carry, at predetermined timing, the sheet of paper P held therebetween toward space between a photosensitive drum 5 and a transfer roller 6.

The photosensitive drum 5 is grounded, and, on the photosensitive drum 5, a photosensitive layer having a positive electrostatic property made of organic photosensitive material, such as polycarbonate, is formed. Further, the photosensitive drum 5 is supported in the laser printer 1 to be rotatable in a counterclockwise direction on FIG. 1.

Around the outer surface of the photosensitive drum 5, a charger 8, a laser scanning unit 9, and a development unit 10 are arranged in this order from the upstream side in the rotational direction of the photosensitive drum 5. The charger 8 is a scorotron type charger for positive electrification configured to cause corona discharge from a charging wire such as a tungsten wire so that the surface of the photosensitive drum 5 is uniformly charged positively. The laser scanning unit 9 emits a laser beam corresponding to image data inputted externally, and scans the laser beam on the surface of the photosensitive drum 5 with a mirror surface of a polygonal mirror rotated by a polygon motor (not shown).

The development unit 10 is located near the photosensitive drum 5 in a horizontal direction, and is configured to supply positively charged toner T to the surface of the photosensitive drum 5 as described later. In this embodiment, non-magnetic polymerized single component toner having a positive electrostatic property is used as toner T.

For this reason, the surface of the photosensitive drum 5 is uniformly charged positively by the charger 8 in accordance with a rotational motion of the photosensitive drum 5, and then is scanned by the high-speed scanning laser beam from the laser scanning unit 9. Thereafter, an electrostatic latent image corresponding to the image data is formed on the surface of the photosensitive drum 5.

Subsequently, when the positively charged toner T is supplied from the development unit 10 to the photosensitive drum 5, the toner T is supplied to and selectively held on parts of the photosensitive drum 5 where the potential is lowered by being exposed to the laser beam, (i.e., the toner T is supplied to the electrostatic latent image on the photosensitive drum 5). As a result, the electrostatic latent image is visualized, and thereby a toner image is formed.

The transfer roller 6 is held in the laser printer 1 to be rotatable in the clockwise direction on FIG. 1. The transfer roller 6 is formed by covering a metal roller shaft with a roller member made of rubber having ionic conductivity. When performing the transferring, a transfer bias voltage (i.e., a forward transfer bias) is applied to the transfer roller 6 from a transfer bias power source (not shown). Therefore, the toner image held on the surface of the photosensitive drum 5 is transferred to the sheet of paper P when the sheet of paper P passes between the photosensitive drum 5 and the transfer roller 6. Although not shown in the drawings, the sheet of paper P after transferring of the toner image is carried to a fixing unit including a heat roller and a pressure roller. After the toner image is fixed by heat, the sheet of paper is ejected to an output tray.

(Configuration of Development Unit)

Hereafter, the configuration of the development unit 10 is explained in detail. As shown in FIG. 1 as a cross sectional view, a development chamber 11 formed to be cylinder-shaped space having an axis parallel with the axis of the photosensitive drum 5, and a reservoir 12 formed as space having a form of a substantially rectangular parallelepiped are formed in the development unit 10. An opening 13 is formed in a part of the development chamber 11 facing the photosensitive drum 5 so that the toner T is supplied to the photosensitive drum 5 through the opening 13. A side part of the reservoir 12 facing the development chamber 11 is formed to have a cylindrical shape whose axis is in parallel with the axis of the photosensitive drum 5, and a communicating channel 14 is formed between the side of the reservoir 12 and the development chamber 11. That is, the inner space of the reservoir 12 is constricted at the side facing the development chamber 11.

A cylindrical support body 15 arranged coaxially with respect to the cylindrical shape of the development chamber 11 is provided in the inside of the development chamber 11, and a cylindrical support body 16 is arranged coaxially with respect to the cylindrical surface on the above described side in the reservoir 12.

An electrode group 21 is buried in the outer surface of the support body 15 to be arranged cylindrically and continuously, and an electrode group 22 is buried in the inner wall of the development chamber 11 to have a predetermined interval with respect to the electrode group 21. Further, an electrode group 25 is buried in the outer surface of the support body 16 to be arranged cylindrically and continuously, and an electrode group 26 is buried in the above described side of the reservoir 12 to have a predetermined interval with respect to the electrode group 25. Furthermore, an electrode group 27 is buried in the bottom surface of the reservoir 12.

Figure 2:
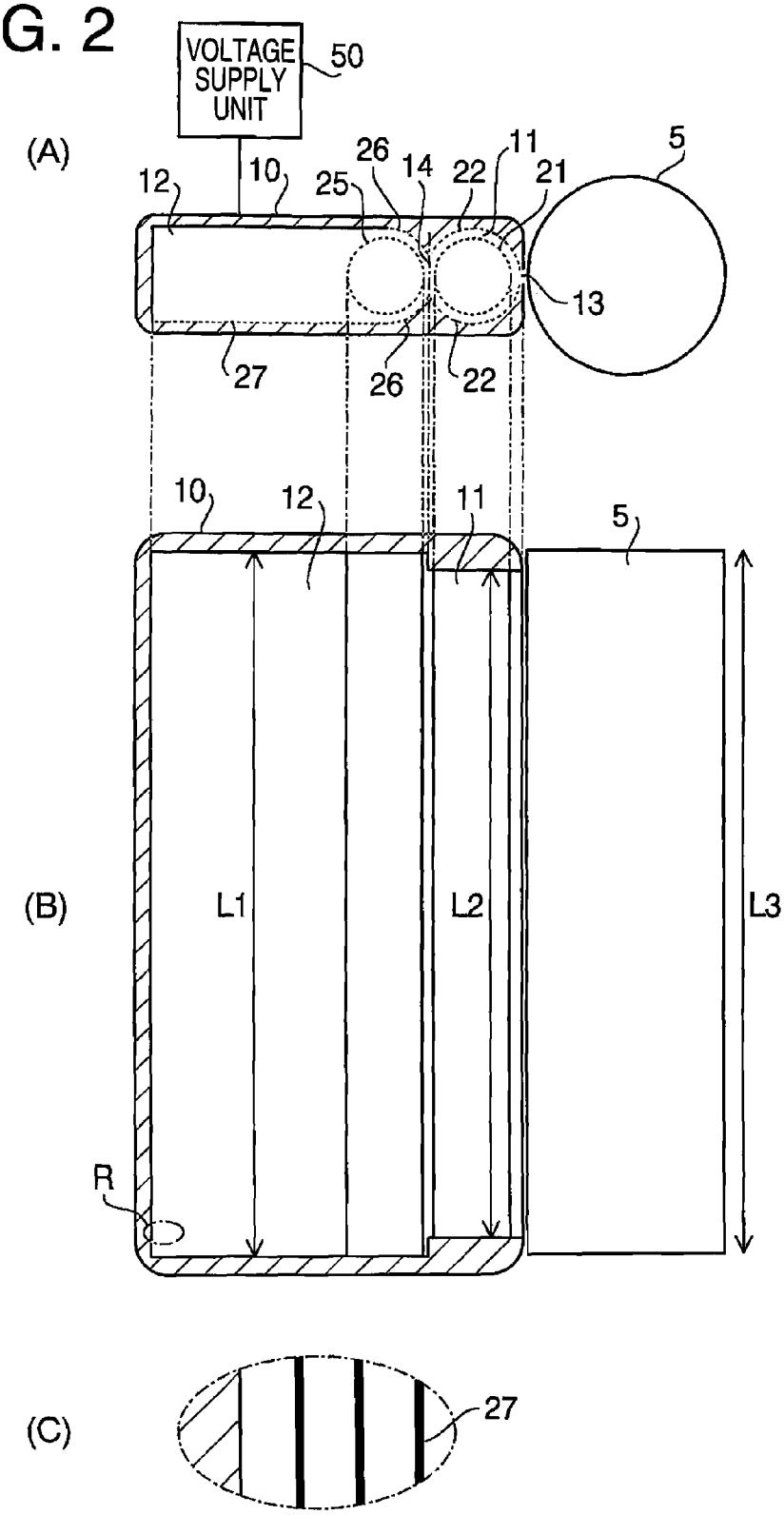

As shown in an illustration of FIG. 2(A) and a lateral cross section of FIG. 2(B), each of electrode groups 21 to 27 is configured such that a plurality of linear electrodes extending in the axial direction of the photosensitive drum 5 are arranged at predetermined intervals in a direction (in which toner T is carried) perpendicular to the axis direction (In FIG. 2(A), each dot of the dotted line corresponds to the linear electrode. Further, for the purpose of clear illustration for FIG. 2(B), linear electrodes included in a region R are shown in FIG. 2(C) in an enlarged view, and other electrodes are omitted.). By applying pulse voltages having phases shifted with respect to each other to the adjacent electrodes from a voltage supply unit 50, a traveling electric field is formed in the electrode groups 21 to 27. A surface of each of the electrode groups 21 to 27 is made of polyimide. Therefore, by friction against the toner T having polyester as a main component, it becomes possible to more suitably charge the toner T positively. Although the voltage supply unit 50 is connected to the development unit 10 in FIGS. 1 and 2 for convenience, actually the voltage supply unit 50 is connected to each electrode in the electrode groups 21 to 27.

As shown in the lateral cross section of FIG. 2(B), the width L1 (the length in the axial direction of the photosensitive drum 5) of the reservoir 12 is substantially equal to the width L3 of the photosensitive drum 5, and the width L2 of the development chamber 11 is shorter than the width L1 both in the right and left directions. The widths of the electrode groups 21 and 22 are approximately equal to L2, and the widths of the electrode groups 25, 26 and 27 are approximately equal to L1. It should be noted that by forming the electrode groups 21 to 27 to have the width larger than or equal to L1 and by burying both ends thereof in the inner walls of the development unit 10 (i.e., the sides in the width direction), it is possible to achieve the similar configuration.

(Operations and Advantages of Development Unit)

In the development unit 10, each of the electrode groups 21 to 27 generates the following traveling electric field by being applied the above described voltage. In the following explanations, directions such as a traveling direction of an electric field are represented in accordance with directions defined on FIG. 2(A). Further, as explained below, the development unit 10 according to the embodiment is configured such that the directions of the traveling electric fields formed on the electrode groups 21 and 25 (i.e., carrying directions of the toner T by the electrode groups 21 and 25) are the same at a portion where the electrode groups 21 and 25 face with each other.

First, the electrode group 27 forms the traveling electric field in the direction proceeding toward the development chamber 11, and the electrode groups 25 and 26 form the traveling electric fields in the counterclockwise direction (i.e., in the direction indicated by an arrow A in FIG. 1), respectively. Therefore, the toner T stored in the reservoir 12 is carried toward the support body 16, and circulates around the support body 16 while passing through the communication channel 14 facing the electrode group 21. Each of the electrode groups 21 and 22 forms the traveling electric field in the clockwise direction (in a direction indicated by an arrow B in FIG. 1). Therefore, part of the toner T carried to the communicating channel 14 as describe above circulates around the support body 15 while passing through the opening 13 facing the photosensitive drum 5.

Figure 3:
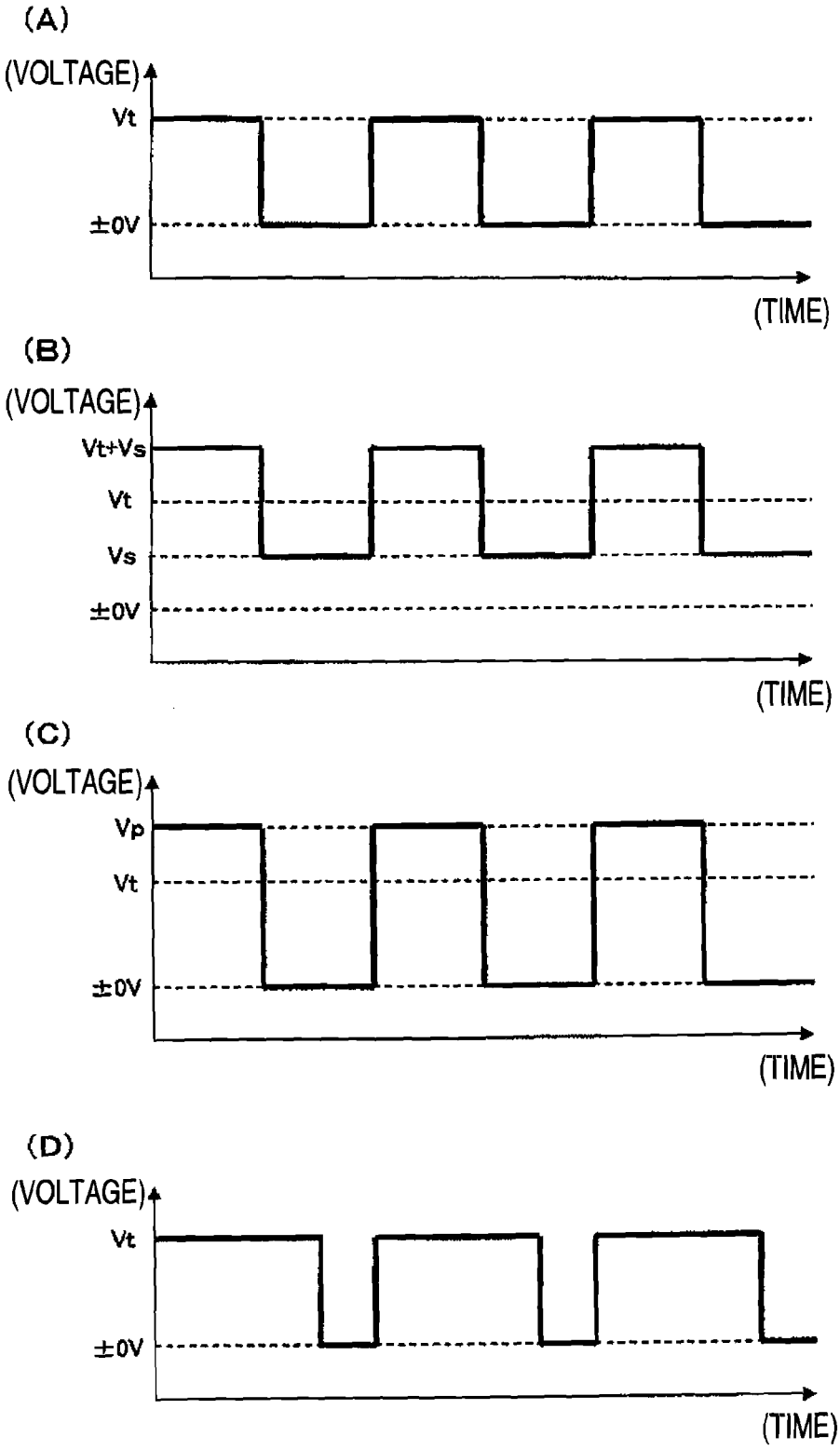
FIG. 3 is an explanatory illustration exemplifying the voltage applied to electrode groups of the development unit.

As shown in FIG. 3(A) as an example, a rectangular wave on which ±0V and a positive voltage Vt appear alternately is applied to each of the electrode groups 21 and 22, while a voltage on which Vt+Vs and Vs having an offset of Vs alternately appears is applied to each of the electrode groups 25 and 26 as shown in FIG. 3(B) as an example. Therefore, when the toner T is carried upward through the communicating channel 14 by the electrode groups 21 an 25, the toner T which is more suitably charged positively is moved preferentially to the development chamber 11. Furthermore, the toner T circulating in the development chamber 11 is supplied to the photosensitive drum 5 in accordance with the electrostatic latent image formed on the photosensitive drum 5, and toner corresponding to the supplied amount is added from the electrode group 25 at the communicating channel 14.

The interval between the electrode groups 21 and 22 is designed to be an appropriate interval such that the amount of the toner T supplied from the communicating channel 14 to the development chamber 11 becomes an appropriate amount. By controlling the voltage to be applied to each of the electrode groups 21 to 27 in response to the consumed amount of the toner T based on image data, it becomes possible to suitably prevent fading from happening on an image, while more suitably suppressing the shortage of supply of the toner T.

That is, according to the development unit 10 of the present invention, the toner T circulates in the development chamber 11, and only a small amount of toner supplied to the photosensitive drum 5 is newly added to the development chamber 11 from the reservoir 12. Therefore, almost all of the toner T in the development chamber 11 is sufficiently charged positively by the frictional charge during the circulating motion, and the charged state of the toner T does not change largely by the small amount of addition from the reservoir 12. Therefore, the toner T charged sufficiently can be supplied to the photosensitive drum 5 stably, and therefore it becomes possible to perform suitable development on the photosensitive drum 5. Furthermore, since the electrode group 21 is formed along the entire circumference of the annular carrying path defined by the inner wall of the development unit 10 and the surface of the support body 15, the toner T is able to smoothly circulate in the development chamber 11. Furthermore, even if a cluster of toner T is added from the reservoir 12 to the development chamber 11, the added amount is limited, and such a cluster of toner T collapses during the circulating motion in the development chamber 11. That is, the cluster of toner T is prevented from reaching the photosensitive drum 5, and therefore the toner T sufficiently charged can be supplied to the photosensitive drum 5.

As described above, since the potential difference Vs is caused between the voltage applied to the electrode groups 25 and 26 and the voltage applied to the electrode groups 21 and 22, the toner T suitably charged positively can be preferentially moved to the development chamber 11. In addition, the toner T also charges positively by friction with respect to the electrode groups 21 to 27. Therefore, in the laser printer 1, it is possible to suitably suppress occurrence of so-called fogging, for example, while preventing inversely charged toner T from being supplied for development of the electrostatic latent image.

Furthermore, since the carrying direction of the toner T by the electrode group 25 and the carrying direction of the toner T by the electrode group 21 are the same at the communicating channel 14, the time in which the toner T moves in the electric field formed by the potential difference Vs becomes long, and therefore it becomes possible to distribute the toner T more suitably. It should be noted that such distribution of toner T can also be achieved in various ways other than the above described way. For example, the voltage to be applied to each of the electrode groups 25 and 26 may be designed such that Vp (>Vt) and ±0V appear alternately as shown in FIG. 3(C) so that the amplitude of the voltage and the average voltage are increased, or may be designed such that the duty ratio increases as shown in FIG. 3(D). In these cases, at least the potential of the side of the electrode group 25 becomes higher than that of the side of the electrode group 21, and therefore the above described distribution of toner can be achieved similarly.

Figure 4:
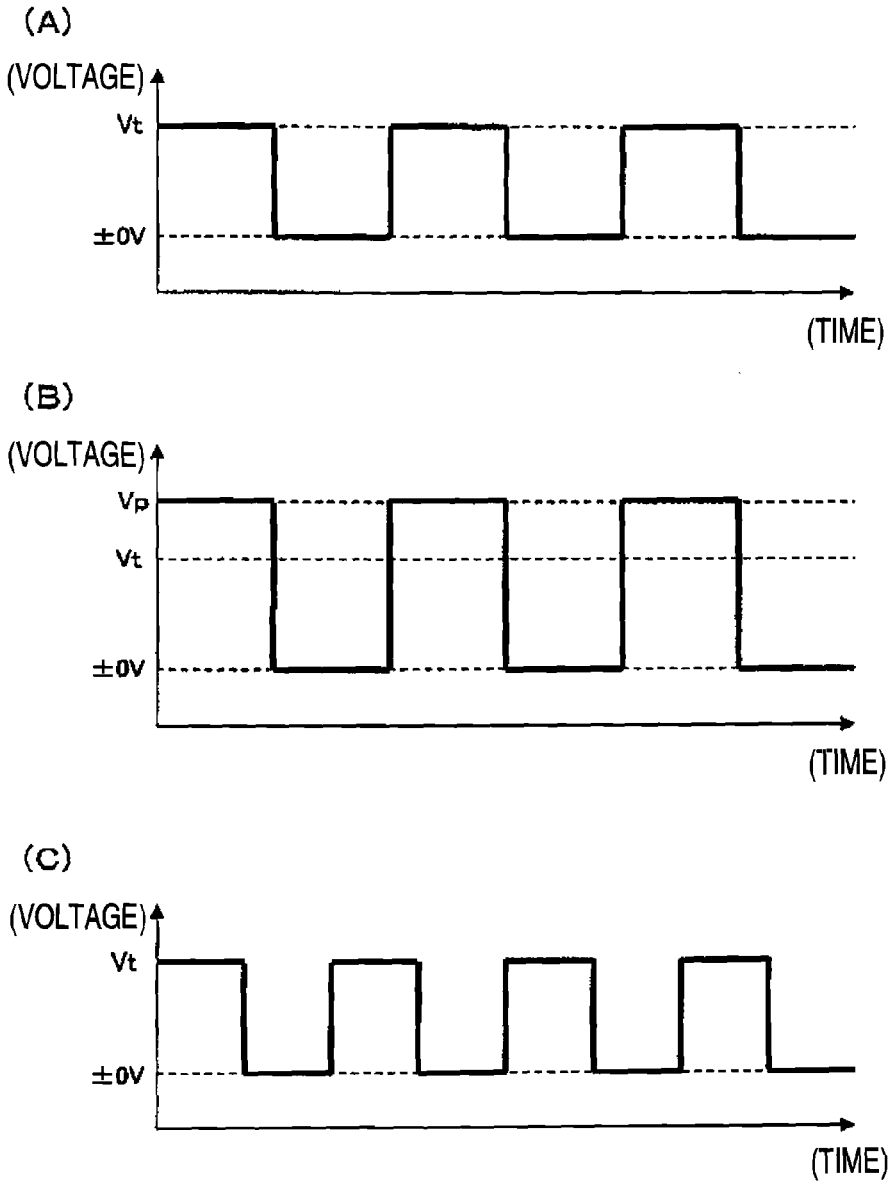
FIG. 4 is an explanatory illustration exemplifying another form of voltage application to be applied to the electrode groups.

In the development unit 10, the width L1 of each of the reservoir 12 and the electrode groups 25, 26 and 27 is larger than the width L2 of each of the development chamber 11 and the electrode groups 21 and 22. Therefore, since, in the development unit 10, the toner T carried along a central portion in the width direction of the electrode groups 25, 26 and 27 is supplied to the electrode groups 21 and 22, it be comes possible to move preferentially the steadily charged toner T to the side of the electrode groups 21 and 22, and to supply the charged toner T in the stably charged state to the photosensitive drum 5. Therefore, in the laser printer 1, a suitable image quality can be obtained for edge parts of a developed image. It should be noted that in order to increase the amount of toner T circulated by the electrode groups 25 and 26, the form of the voltage to be applied to each of the electrode groups 21 to 26 may be designed as follows. For example, when the rectangular waveform voltage on which Vt and ±0V appear alternately is applied to the electrode groups 21 and 22 as shown in FIG. 4(A), the absolute value of the voltage may be heightened such that the voltage on which Vp (>Vt) and ±0V appear alternately is applied to the electrode groups 25 and 26 as shown in FIG. 4(B), or the frequency may be increased as shown in FIG. 4(C). In these cases, by the difference between carrying forces caused by the difference of the forms of the applied voltages, it becomes possible to increase the amount of toner T circulated by the electrode groups 25 and 26 in comparison with the amount of toner T circulated by the electrodes 21 and 22. In this case, it becomes possible to prevent more suitably occurrence of shortage of toner T to be supplied to the photosensitive drum 5.

Other Embodiments of the Present Invention

Figure 7:
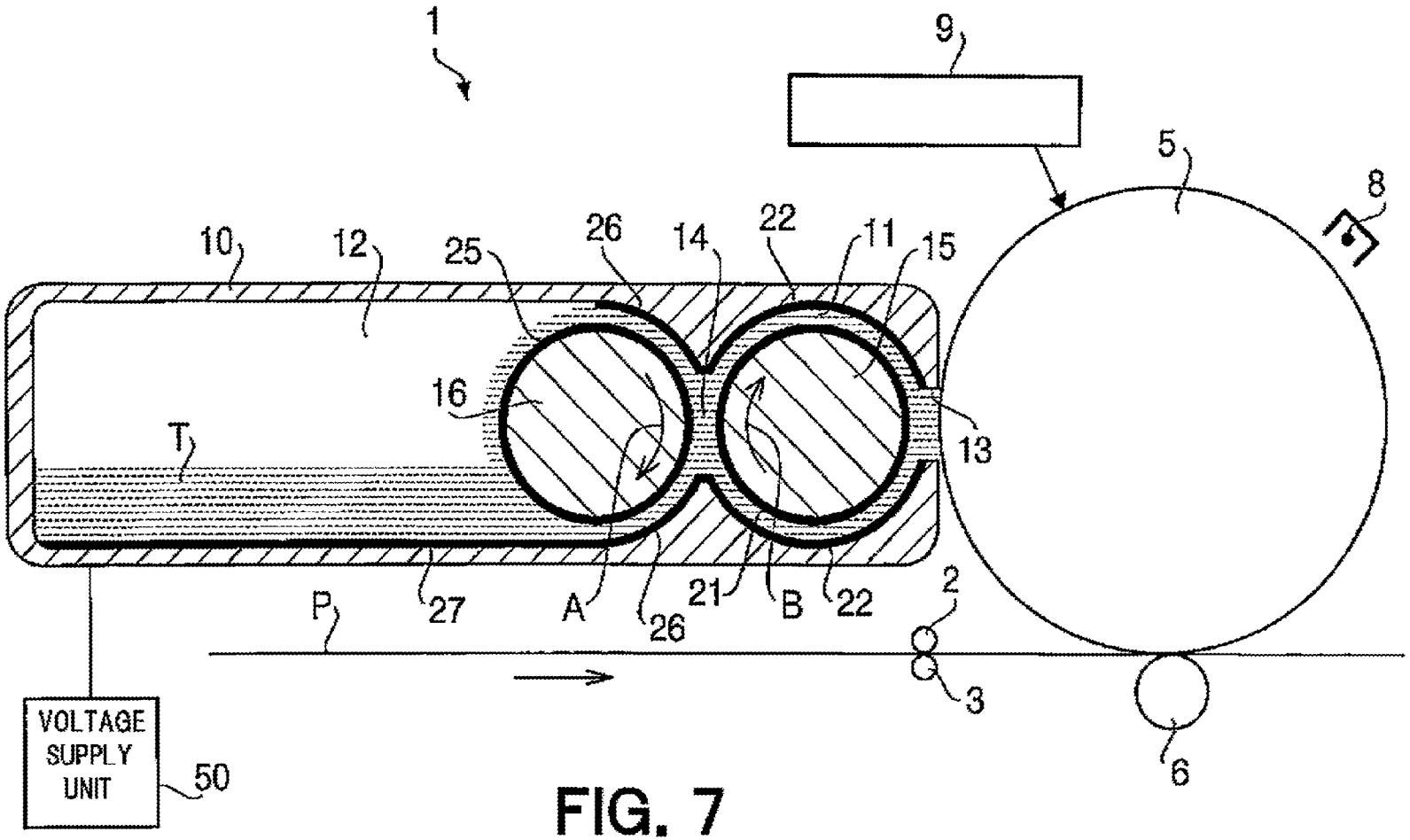
FIG. 7 is a vertical cross section illustrating the configuration of a development unit according to yet another embodiment.

It should be noted that the present invention is not limited to the above described embodiments, and the present invention can be implemented in various types of embodiments without departing from the scope of the invention. For example, although in the above described embodiment each of the electrode groups 25 and 26 forms the traveling waveform in the counterclockwise direction, the traveling waveform in the clockwise direction (i.e., in the direction opposite to direction of the arrow A on FIG. 1) may be generated. In this case, the carrying direction of toner T by the electrode groups 25 and 26 becomes an inversed direction of the carrying direction of toner T by the electrode groups 21 and 22 at the communicating channel 14, as shown in FIG. 7. In this case, the toner T sufficiently charged positively moves rapidly from the side of the electrode group 25 to the side of the electrode group 21 without staying at the communicating channel 14 for a long time, and is carried in the opposite direction. On the other hand, when the toner T, which has not supplied to the photosensitive drum 5 and stays in the development chamber 11, reaches the communicating channel 14, the toner T is stirred by colliding with the toner T flowing in the opposite direction, and part of the stirred toner T flows into the reservoir 12 by being directed by the flow of the toner T in the opposite direction.

There may a case where, when the toner T corresponding to the latent image is supplied to the photosensitive drum 5 at the opening 13, a hollow part (which is not filled with the toner T) corresponding to the latent image appears in the development chamber 11. When the toner T circulates in the development chamber 11 without being stirred sufficiently in this state and is supplied to the photosensitive drum 5 again, an image formed by combining a reverse image (which is referred to as a ghost in this specification) of the hollow part with a normal latent image may be developed on the photosensitive drum 5. However, by stirring forcibly the toner T by employing the above described configuration, it becomes possible to prevent occurrence of such a ghost.

Furthermore, in this case, since the portion of the communicating channel 14 where the development chamber 11 and the reservoir 12 communicate with each other is constricted, part of the toner T carried by the electrode groups 21 and 22 to the bottom of the communicating channel 14 from the portion facing the photosensitive drum 5 is facilitated to collide with part of the toner T carried to the top end of the communicating channel by the electrode groups 25 and 26 while flowing in the opposite directions. Therefore, the toner T is easily stirred at the communicating channel 14, and as a result occurrence of a ghost can be prevented.

Figure 5:
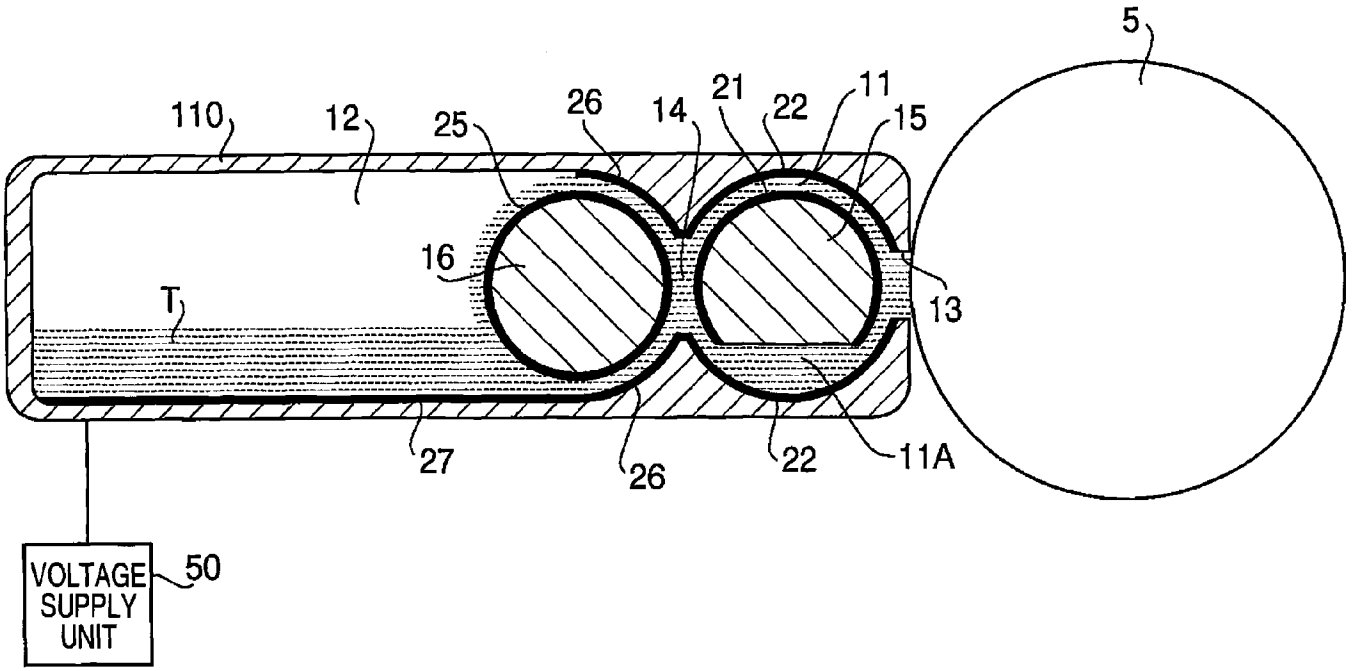
FIG. 5 is a vertical cross section illustrating the configuration of a development unit according to another embodiment.

As shown in FIG. 5 where a development unit 110 is illustrated, a lower edge part of the support body 15 may be cut so that a toner buffer 11A for storing temporarily the toner T is formed in the lower part of the development chamber 11. In this case, the toner T which has not supplied to the photosensitive drum 5 is stored temporarily in the toner buffer 11A, and reaches the communicating channel 14 after the amount of toner T corresponding to the supplied amount to the photosensitive drum 5 is added. Therefore, the amount of toner reaching the communicating channel 14 is kept substantially at a constant level regardless of the amount of toner used for the latent image. As described above, by returning the constant amount of toner to the communicating channel 14, collision and stirring of the toner T flowing in directions opposite to each other can be secured, and therefore it becomes possible to suitably prevent occurrence of a ghost. In the example shown in FIG. 5, although an electrode group is not formed on the lower edge surface of the support body 15, an electrode group continuously connected to the electrode group 21 may be formed on this part. In this case, the toner T circulates around the support body 15 more smoothly.

In the embodiment shown in FIG. 5, at the timing when development of the electrostatic latent image is not performed (e.g., the time when the sheet of paper P is ejected), only the electrode group 22 on the lower side of the support body 15 forms the traveling electric field in the clockwise direction on FIG. 5, and the electrode group 26 on the upper side of the support body 16 and the electrode group 25 form the traveling electric field in the counterclockwise direction. By this configuration, it becomes possible to return the toner T stored in the toner buffer 11A to the reservoir 12, and to supply new toner T to the development chamber 11 for next printing. Therefore, it becomes possible to prevent alteration of the property of the toner T due to storing in the toner buffer 11A over a long time. That is, in the embodiment shown in FIG. 5, the electrode group 22 on the lower side with respect to the support body 15 corresponds to a third electrode group.

Figure 6:
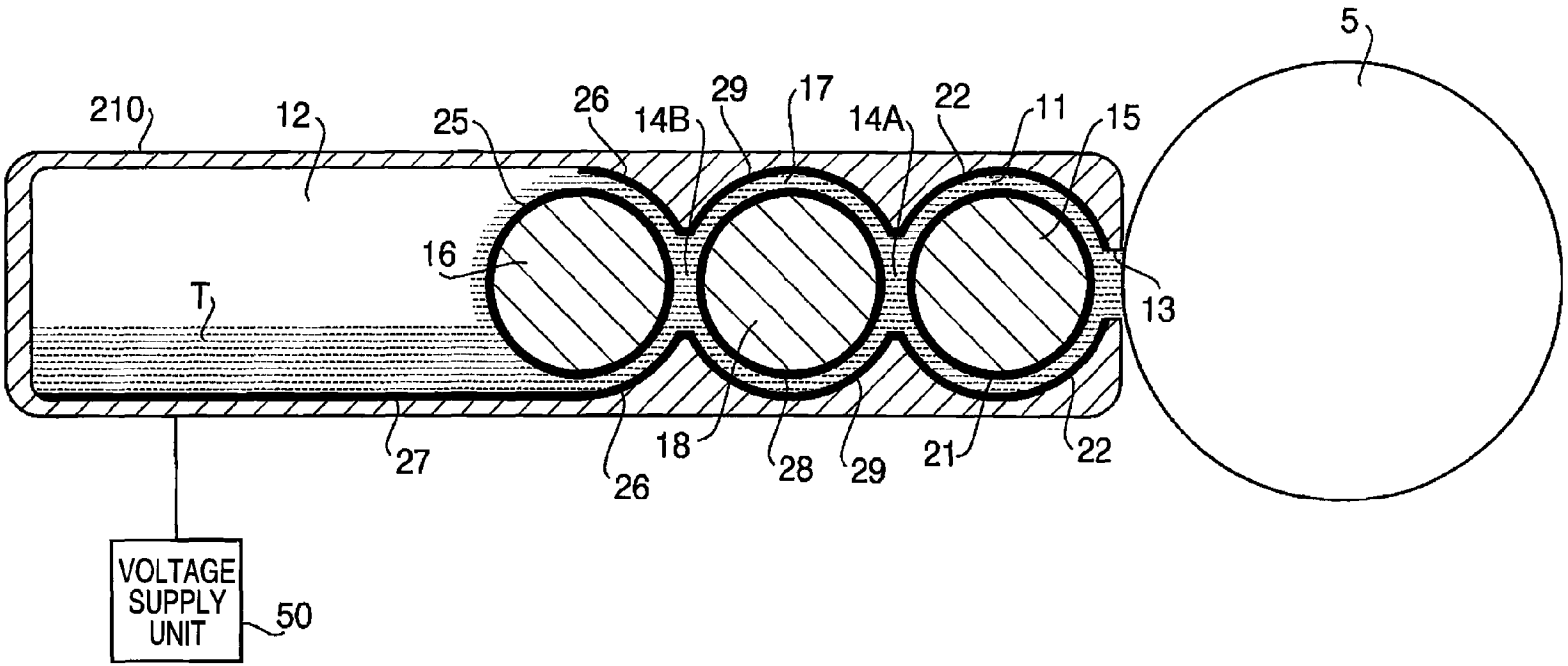
FIG. 6 is a vertical cross section illustrating the configuration of a development unit according to still another embodiment.

Further, as shown in FIG. 6 where a development unit 210 is illustrated, cylindrical space 17 may be formed between the development chamber 11 and the reservoir 12 to have an axis which is parallel with the axis of the photosensitive drum 5, and a support body 18 may be provided in the space coaxially with the cylindrical shape. By connecting the development chamber 11, the space 17 and the reservoir 12 through communicating channels 14A and 14B and by forming electrode groups 28 and 29 on the outer surface of the support body 18 and the inner wall of the space 17 to form the traveling electric field, it becomes possible to perform the development as in the case of the above described embodiment. In this case, by performing the above described distribution of toner two times at the communicating channels 14B and 14A, it becomes possible to prevent occurrence of fogging more suitably.

In the above described embodiments, the electrode group contacting the toner T from the upper side may be omitted, and a developer supply target may be a development roller. Furthermore, an electrostatic latent image holding body may have a belt-like structure, and an electrostatic latent image may be formed by the ways other than exposure.

What is claimed is:

1. A developer carrying device, comprising:

a reservoir;

a development chamber;

a first carrying body arranged in the development chamber and having a first electrode group configured to form a traveling electric field while being applied a voltage sequentially and to circulate charged developer through a facing portion with respect to a developer supply target;

a second carrying body arranged in the reservoir and configured to circulate the developer through a facing part with respect to the first electrode group so that the developer being carried is supplied to the first carrying body, wherein the second carrying body includes a second electrode group configured to form a traveling electric field while being applied a voltage sequentially;

a third electrode group buried in an inner wall of the development chamber with a predetermined spacing from the first electrode group; and a fourth electrode group buried in the reservoir with a predetermined spacing from the second electrode group, wherein a space between the first carrying body and the second carrying body defines a boundary between the development chamber and the reservoir.

2. The developer carrying device according to claim 1, wherein the first electrode group is continuously arranged to have a cylindrical shape.

3. The developer carrying device according to claim 1, wherein a surface of the first electrode group is made of material configured to charge the developer in a desired state.

4. The developer carrying device according to claim 1, further comprising a developer buffer configured to temporarily store the developer being circulated and is formed at least on a part of the first carrying body.

5. The developer carrying device according to claim 4, further comprising a third carrying body having a fifth electrode group configured to form a traveling electric field while being applied a voltage sequentially and to carry the developer stored in the developer buffer to the second carrying body.

6. The developer carrying device according to claim 1, wherein:

the voltage applied to the first electrode group and the voltage applied to the second electrode group are defined such that the developer charged in a desired state is moved from the second carrying body to the first carrying body at least at the facing part where the first and second electrode groups face each other, and carrying directions of the developer by the first and second electrode groups at the facing part are opposite to each other.

7. The developer carrying device according to claim 6, wherein a potential difference is caused between the voltage applied to the first electrode group and the voltage applied to the second electrode group.

8. The developer carrying device according to claim 6, wherein:

an amplitude of the voltage applied to the first electrode group and an amplitude of the voltage applied to the second electrode group are different from each other; and an average voltage of the voltage applied to the first electrode group and an average voltage of the voltage applied to the second electrode group are different from each other.

9. The developer carrying device according to claim 6, wherein a duty ratio of the voltage applied to the first electrode group and a duty ratio of the voltage applied to the second electrode group are different from each other.

10. The developer carrying device according to claim 1, wherein:

the voltage applied to the first electrode group and the voltage applied to the second electrode group are defined such that the developer charged in a desired state is moved from the second carrying body to the first carrying body at least at the facing part where the first and second electrode groups face with each other, and carrying directions of the developer by the first and second electrode groups at the facing part are equal to each other.

11. The developer carrying device according to claim 1, wherein an amount of the developer circulated by the second electrode group is larger than an amount of the developer circulated by the first electrode group.

12. The developer carrying device according to according to claim 11, wherein an absolute value of the voltage applied to the second electrode group is larger than an absolute value of the voltage applied to the first electrode group.

13. The developer carrying device according to claim 11, wherein a frequency of the voltage applied to each electrode of the second electrode group is higher than a frequency of the voltage applied to each electrode of the first electrode group.

14. The developer carrying device according to claim 1, wherein a width of the second carrying body is larger than a width of the first carrying body.

15. An image forming device, comprising:

an electrostatic latent image holding body having a surface configured to hold an electrostatic latent image;

the developer carrying device according to claim 1, wherein the developer carrying device uses the electrostatic latent image holding body as the developer supply target; and a transfer unit configured to transfer the developer supplied to the electrostatic latent image holding body by the developer carrying device, to a recording medium.

16. The developer carrying device of claim 1, wherein the second carrying body is disposed wholly within the reservoir.

17. The developer carrying device of claim 1, wherein the first carrying body is disposed wholly within the development chamber.

* * * * *